United States Patent [19]

Terai

[11] Patent Number: 4,567,541

[45] Date of Patent: Jan. 28, 1986

[54] ELECTRIC POWER SOURCE FOR USE IN ELECTROSTATIC PRECIPITATOR

[75] Inventor: Hiroshi Terai, Hiratsuka, Japan

[73] Assignee: Sumitomo Heavy Industries, Ltd., Tokyo, Japan

[21] Appl. No.: 576,664

[22] Filed: Feb. 3, 1984

[30] Foreign Application Priority Data

Feb. 7, 1983 [JP] Japan ..... 58-18578
May 20, 1983 [JP] Japan ..... 58-89790

[51] Int. Cl.[4] ..... H01T 23/00

[52] U.S. Cl. ..... 361/235; 307/2; 307/60; 323/903; 55/139

[58] Field of Search ..... 307/1, 2, 52, 60, 85; 361/235, 225; 55/139; 323/903

[56] References Cited

U.S. PATENT DOCUMENTS 3,648,437 3/1972 Bridges ..... 323/903 X
4,233,039 11/1980 Schmidt ..... 307/2 X
4,413,225 11/1983 Dönig et al. ..... 307/2 X
4,485,428 11/1984 Harris ..... 361/235

OTHER PUBLICATIONS

Japanese Patent Publication No. 57-43062, dated Sep. 11, 1982.

"High Voltage Thyristors Used in Precipitator", Control Engineering, pp. 129-136, Aug. 1981.

*Primary Examiner*—Harry E. Moose, Jr.
*Assistant Examiner*—Derek S. Jennings
*Attorney, Agent, or Firm*—Flynn, Thiel, Boutell & Tanis

[57] ABSTRACT

An electric power source for use in an electrostatic precipitator includes a first high voltage DC source having an output terminal adapted to be connected to discharge electrodes of the electrostatic precipitator. An inductor is connected at its one end through a coupling capacitor to the output terminal. A controlled rectifier is connected at its an anode to the other end of the inductor and has a grounded cathode. A diode is connected in a reversed parallel to the controlled rectifier. There is also provided a second high voltage DC source having a high output impedance and connected to the inductor, and the controlled rectifier is turned on and off by a controller.

20 Claims, 7 Drawing Figures

ELECTRIC POWER SOURCE FOR USE IN ELECTROSTATIC PRECIPITATOR

FIELD OF THE INVENTION

The present invention relates to an electric power source for use in an electrostatic precipitator, and more specifically to such a power source having a high voltage pulse source for superimposing a voltage pulse on a constant high voltage DC current supplied between discharge electrodes and collecting electrodes.

DESCRIPTION OF THE PRIOR ART

In electrostatic precipitators, it is well known to superimpose high voltage pulses on a DC high voltage supplied to the discharge electrode in order to increase the effeciency of dust collection. Such a superimposition of high voltage pulses on the DC high voltage makes it possible to control the average current in the precipitator independently of the average voltage by changing the repetition frequency of the pulses, thereby preventing high resistance particles deposited and collected on the collecting electrode from accepting excess current and causing back ionization.

Heretofore, there have been known three methods as means for generating and superimposing such high voltage pulses on a constant high voltage DC current. In the first method an electric charge is stored in a storage capacitor and is then supplied through a sparking gap to the electrode of the precipitator. This method can generate an extremely short pulse having a width of 1 microsecond, for example. However, since it is not possible to recover the electric energy of the pulses applied between the electrodes of the precipitator, energy consumption is very large.

The second method is one such as that disclosed in Japanese Patent Publication No. Sho 57-43062 in the name of F. L. Smidth & Co., A.S. Referring to FIG. 1, there is shown a circuit diagram illustrating the principle of this second method. A high voltage DC source is composed of a transformer 1 and a rectifier bridge 2 connected across the secondary winding of the transformer 1. The output of the rectifier bridge 2 is connected through an impedance 3 to one end of a storage capacitor 4 whose other end is grounded. The one end of the capacitor 4 is also connected to the cathode of a thyristor 5, whose anode is connected through an inductor 6 to the discharge electrodes 7 of the electrostatic precipitator. The collecting electrodes 8 of the precipitator are grounded. A diode 9 is connected in reversed parallel to the thyristor 5, and the gate of the thyristor 5 is connected to a controller 10.

In the power source circuit as shown in FIG. 1, electric charge is stored in the capacitor 4 from the DC source, and when the thyristor 5 is turned on, the electric charge stored in the capacitor 4 is discharged through the inductor 6 to the discharge electrodes 7 in the form of a voltage pulse. Thereafter, the electric energy of the pulse applied to the precipitator is recovered through the diode 9 to the capacitor 4 by the action of LC vibration caused by the inductor 6 and the capacitor $C_{EP}$ formed between the discharge electrodes 7 and the collecting electrodes 8.

In this power source circuit, since neither the anode nor the cathode of the thyristor 5 is grounded, the potential difference between the gate and the cathode of the thyristor 5 floatingly varies irrespectively of whether a trigger signal is supplied to the gate from the controller 10. Because of this, a large potential difference is often caused between the gate and the cathode of the thyristor 5, resulting in erroneous opening of the thyristor 5. Therefore, it is very difficult to accurately turn the thyristor 5 on and off.

In addition, in order to superimpose the pulse generated by the circuit shown in FIG. 1 upon a variable high DC voltage directly supplied by the other source (not shown) to the discharge electrodes, it is necessary to connect a coupling capacitor between the inductor 6 and the discharge electrodes 7 and also to ground the connection between the inductor 6 and the coupling capacitor through another inductor or a resistor. However, if the grounding inductor or resistor is connected to the pulse generating circuit, electric energy will leak through the grounding inductor or resistor. Accordingly, the circuit inevitably has a considerable energy loss.

The third method is disclosed by Jerry F. Shoup and Thomas Luger in "High Voltage Thyristors Used in Precipitator", *Control Engineering*, 129–136, August 1981. FIG. 2 shows the basic circuit for this third method. This circuit has a high voltage DC source 11 whose output is connected through an impedance 12 to the discharge electrodes 7 of the precipitator. The circuit also has another DC source 13 having an output voltage E and connected to the discharge electrodes 7 through a thyristor 14, an inductor 15 and a coupling capacitor 16. The connection between the inductor 15 and the coupling capacitor 16 is connected to a storage capacitor 17 and is grounded through another inductor 18 and another thyristor 19. The gates of the thyristors 14 and 19 are connected to a controller 20.

In this circuit, firstly, the thyristor 14 is opened by the controller 20 so that the storage capacitor 17 is charged by the second DC source 13. At this time, because of LC vibration caused by the inductor 15 and the storage capacitor 17, the capacitor 17 is charged to a voltage 2E. At this moment, the thyristor 19 is opened by the controller 20, so that the capacitor 17 is discharged through the inductor 18 and the thyristor 19. At the moment the voltage of the storage capacitor 17 becomes −2E because of LC vibration caused by the inductor 18 and the storage capacitor 17, the thyristor 14 is opened again and the thyristor 19 is closed, so that the capacitor 17 is charged again. At this time, since the potential difference is 4E, the storage capacitor 17 is charged to 4E because of LC vibration by the inductor 15 and the capacitor 17. Accordingly, the voltage of the storage capacitor 17 is changed from 2E to −2E and then to 4E.

If the circuit repeats the above operation once more, the voltage of the capacitor 17 is changed from 4E to −4E and then to 6E. Namely, the voltage of the storage capacitor 17 is increased step by step by repeated charging and discharging, and is supplied in the form of a pulse to the discharge electrodes 7.

Therefore, in order to protect the precipitator and the high voltage DC source 11 from an extremely high voltage pulse, it is necessary to restrain the pulse voltage generated by the pulse generating circuit. For this purpose, the pulse energy has to be consumed at each repetition of the discharge and charge of the storage capacitor 17. On the other hand, the storage capacitor 17 is charged by the DC source 13 after each discharge of the capacitor. This also means electric energy comsumption. Therefore, even in the third method, energy consumption is very large.

In addition, the thyristors 14 and 19 must be turned on and off by the controller 20 with high precision. The reason for this is that if the thyristors are not alternately turned on and off with high precision, the voltage of the capacitor 17 will not be raised by 2E at each repetition of the charge-discharge cycle.

In any case, the most significant problem common to the above-mentioned three conventional methods is the use of a storage capacitor which is required to have a capacitance several times that between the discharge electrode and the collecting electrode of the electrostatic precipitator, and a voltage rating sufficiently larger than voltage of the pulse. Specifically, the capacitance in the precipitator is ordinarily about 0.01 to 0.1 microfarads and the pulse voltage is for example 30 to 50 KV. Therefore, the storage capactor is very expensive and actually accounts for about 10 to 20 percent of the price of the electric power source for the precipitator.

SUMMARY OF THE INVENTION

Accordingly, it is a primary object of the present invention to provide an inexpensive electric power source for use in an electrostatic precipitator, in which voltage pulses can be generated without use of a storage capacitor, and the electric energy of the pulse supplied to the precipitator can be effectively recovered so as to minimize power consumption.

Another object of the present invention is to provide such an electric power source in which a controlled rectifier can be precisely and surely turned on and off without being subjected to the influence of the precipitator.

The above and other objects of the present invention are achieved by an electric power source for use in an electrostatic precipitator constructed in accordance with the present invention, which comprises a first high voltage DC source having an output terminal adapted to be connected to the discharge electrodes of the electrostatic precipitator, and an inductor having one end connected through a coupling capacitor to said output terminal, a controlled rectifier having its anode connected to the other end of said inductor and its cathode connected to ground, a diode connected in reversed parallel to said controlled rectifier, a second high voltage DC source having a high output impedance and connected to said inductor, and a controller supplying a trigger pulse to the gate of said controlled rectifier.

In the above electric power source, the precipitator capacitance formed between the discharge electrodes and the collecting electrodes of the precipitator is utilized as a storage capacitor and is charged through the coupling capacitor by the second high voltage DC source. In this condition, if the controlled rectifier is opened by the controller, the charge stored in the discharge electrodes of the precipitator capacitance is discharged through the coupling capacitor, the inductor and the controlled rectifier into the collecting electrodes of the precipitator capacitance because of LC vibration caused by the inductor and the precipitator capacitance. Thereafter, the electric charge stored in the collecting electrodes of the precipitator capacitance is discharged through the coupling capacitor and the diode connected in reversed parallel to the controlled rectifier to the discharge electrodes of the precipitator. As a result, one pulse is supplied to the discharge electrodes of the precipitator, and therefore is superimposed on the high DC voltage supplied to the discharge electrodes from the first high voltage DC source.

From another viewpoint, the electric energy discharged from the precipitator capacitance is returned to the precipitator capacitance. Therefore, a voltage pulse can be generated without storage capacitance independent of the precipitator capacitance formed by the discharge electrodes and the collecting electrodes, and the electric energy of the pulse can be effectively recovered without substantial loss so as to minimize power consumption.

In addition, the controlled rectifier can repeatedly be turned on at any interval which is not shorter than the vibration period or time constant determined by the inductor, the coupling capacitor and the precipitator capacitance. Therefore, the controller may be an independently operated pulse generator adapted to supply the gate of the controlled rectifier with pulses having a variable or constant pulse repetition period independent of the time constant as mentioned above.

Furthermore, in the power source as mentioned above, since the cathode of the controlled rectifier is grounded, the potential difference between the gate and the cathode of the controlled rectifier is not subjected to the influence of the precipitator. Therefore, the controlled rectifier can be easily and precisely turned on and off by a simple and inexpensive controller.

The above and other objects and features of the present invention will become apparent from the following detailed description of preferred embodiments with reference to the accompanying drawings.

DETAILED DESCRIPTION OF PREFERRED EMBODIMENTS

Figure 1:
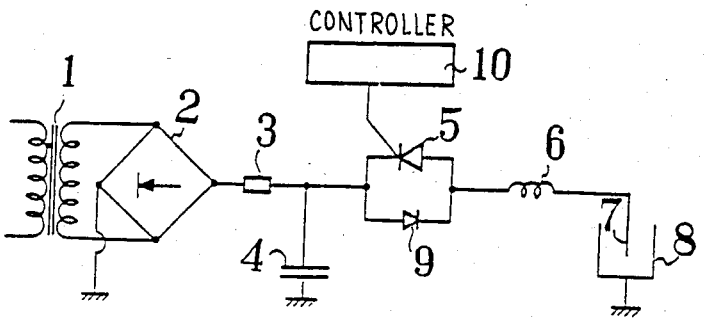
FIGURE 1 PRIOR ART
FIGS. 1 and 2 are circuit diagrams showing the principles of conventional electric power sources for use in an electrostatic precipitator.
Figure 2:
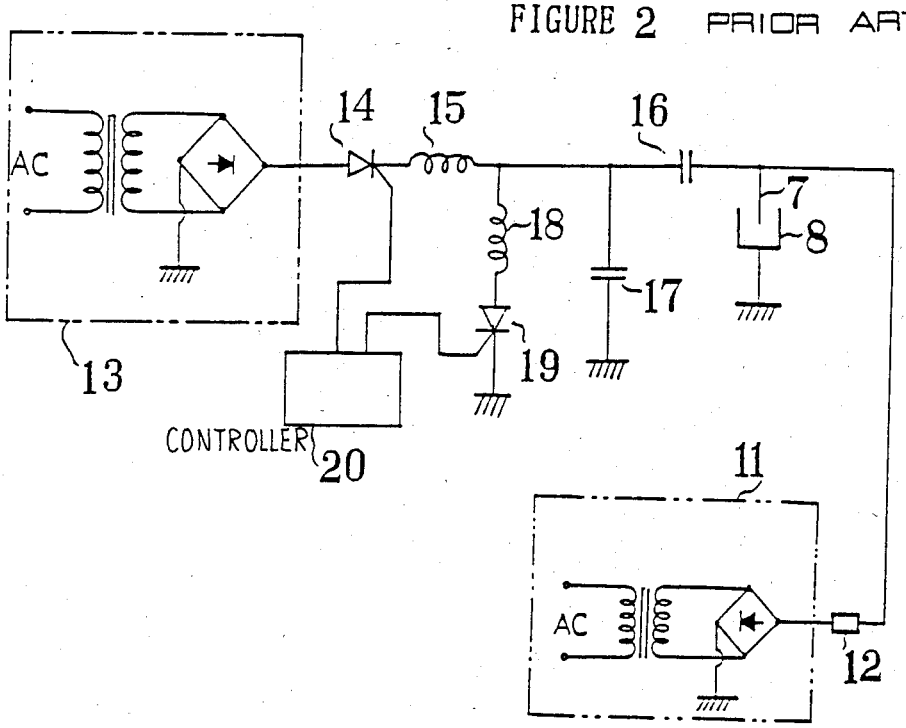
FIGURE 2 PRIOR ART
Figure 3:
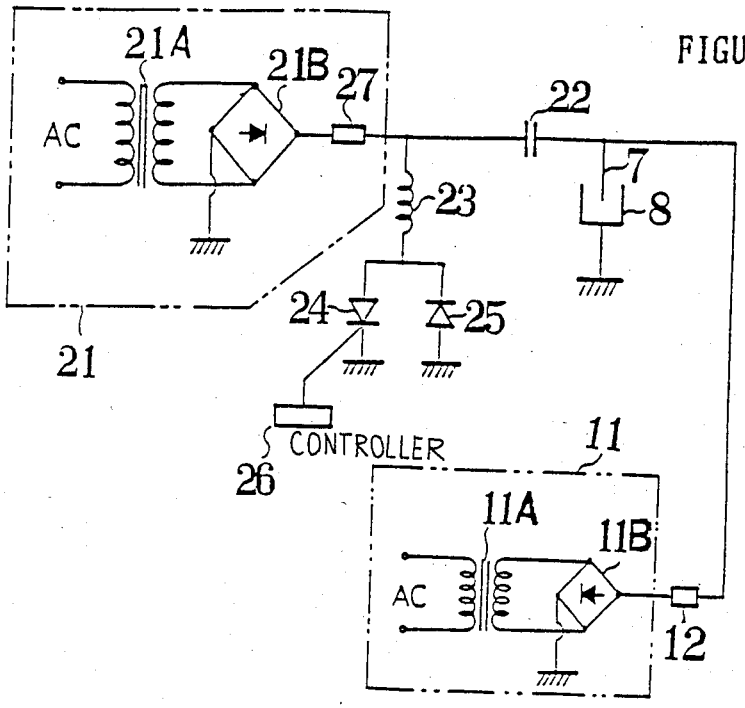
FIG. 3 is a circuit diagram of a first embodiment of an electric power source in accordance with the present invention for use in an electrostatic precipitator.

Referring to FIG. 3, there is shown a circuit diagram of a first embodiment of an electric power source in accordance with the present invention for use in an electrostatic precipitator. Portions similar to those of the conventional power source shown in FIG. 2 are given the same Reference Numerals.

The shown power source comprises a high voltage DC source 11 which is constituted by a transformer 11A having a primary winding connected to an AC source and a high voltage secondary winding connected to a rectifier bridge 11B. The positive output terminal of the rectifier bridge 11B is grounded and the negative output terminal of the rectifier bridge 11B is connected through an impedance 12 to the discharge electrodes 7 of the precipitator so as to supply it with a voltage $V_{DC}$ substantially corrsponding to the corona discharge starting voltage in the precipitator. The collecting electrodes 8 of the precipitator are grounded.

The power source also has another high voltage DC source 21 which comprises a transformer 21A having a primary winding connected to an AC source and a high voltage secondary winding connected to a rectifier bridge 21B. The negative output terminal of the rectifier bridge 21B is grounded and the positive output terminal of the rectifier bridge 21B is connected through a coupling capacitor 22 to the discharge electrodes 7. This coupling capacitor 22 is provided to block the DC component and to pass the AC component. The coupling capacitor 22 is required to have a capacitance which is sufficiently larger than the capacitance $C_{EP}$ in the precipitator, which is mainly determined by the capacitance between the discharge electrode 7 and the collecting electrodes 8.

The connection between the DC source 21 and the coupling capacitor 22 is connected to one end of an inductor 23, whose other end is connected to the cathode of a controlled rectifier 24, such as a thyratron or series-connected thyristors, and also to the anode of a diode 25. The anode of the controlled rectifier 24 and the cathode of the diode 25 are grounded. The gate of the controlled rectifier 24 is connected to a controller 26.

The secondary winding of the transformer 21A is required to have a large inductance so that the DC source 21 has a sufficiently large impedance so as to make as small as possible the current flowing from the DC source 21 through the controlled rectifier 24 to the ground when the controlled rectifier 24 is turned on. Therefore, instead of using a transformer with a large inductance, a current-limiting reactor may be connected in series with the primary or secondary winding of the transformer 21A. Otherwise, an impedance 27 of a suitable value may be connected between the positive output terminal of the rectifier bridge 21B and the inductor 23. Therefore, the term "DC source having a high output impedance" should be interpreted to include all possible constructions which can restrain the current from the DC source through the inductor 23 to the ground when the controlled rectifier 24 is turned on.

However, in this embodiment, the impedance 27 is necessary for ensuring the possibility of the potential at the connection between the inductor 23 and the coupling capacitor 22 going to a negative potential.

Now, assume that the DC source 21 has an output voltage E and the output impedance of the transformer 21A is infinite. Also assume that the forward directional resistances of the rectifier bridge 21B and the diode 25 are zero and the forward resistance of the controlled rectifier 24 is zero in a conductive condition and infinite in a non-conductive condition. Furthermore, assume the condition that the DC source 11 is disconnected from the precipitator and the coupling capacitor 22 is omitted. Also assume that the current flowing toward the precipitator is i(t) and the voltage between the discharge and collecting electrodes 7 and 8 is v(t).

In this condition, when the controlled rectifier 24 is non-conductive, v(t)=E and i(t)=0. At the time of t=0, if the controlled rectifier 24 is turned on by the controller 26, the following equations are established:

$$C_{EP}(d/dt)v(t)=i(t) \quad (1)$$

$$-L\cdot d/dt\,i(t)=v(t) \quad (2)$$

where L=inductance of the inductor 23. If these equations (1) and (2) are solved on the basis of the conditions i(0)=0 and v(0)=E, v(t) and i(t) are as follows:

$$v(t) = E\cos\left(\sqrt{\frac{1}{L\cdot C_{EP}}}\cdot t\right) \quad (3)$$

$$i(t) = -E\sqrt{\frac{C_{EP}}{L}}\sin\left(\sqrt{\frac{1}{L\cdot C_{EP}}}\cdot t\right) \quad (4)$$

The above equation (2) is established on the basis of the condition that the no-load end of the inductor 23 opposite to the load which is the precipitator is grounded. In fact, when the controlled rectifier 24 is turned on, the no-load side of the inductor 23 is initially grounded through the controlled rectifier 24. Thereafter, when i(t)>0, the controlled rectifier 24 is turned off, but the diode 25 becomes forward to the direction of the current. Therefore, during the time period of $0\leqq t<2\pi\sqrt{L\cdot C_{EP}}$, since the above condition is actually fulfilled, the equation (2) is effective.

Figure 4:
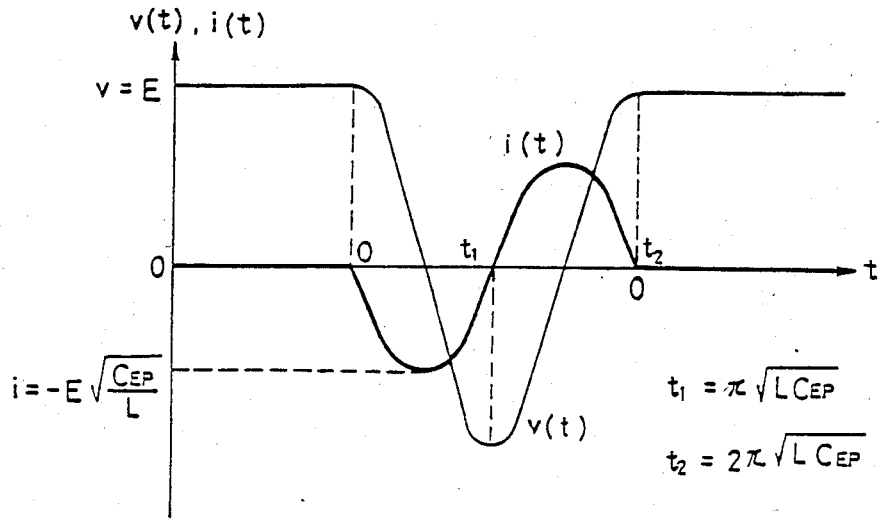
FIG. 4 shows waveforms of precipitator voltage and current produced by a voltage pulse generating circuit incorporated into the embodiment shown in FIG. 3.

Accordingly, during the time period of $0<t<\pi\sqrt{L\cdot C_{EP}}$, since i(t)<0, the current discharged from the discharge electrodes 7 of the precipitator capacitance $C_{EP}$ flows through the controlled rectifier 24 to the collecting electrodes 8 of the precipitator capacitance. During the time period of $\pi\sqrt{L\cdot C_{EP}}<t<2\pi\sqrt{L\cdot C_{EP}}$, since i(t)>0, the controlled rectifier 24 is turned off, but the electric charge stored in the collecting electrodes 8 is returned to the discharge electrodes 7 through the diode 25. At the time of $t=2\pi\sqrt{L\cdot C_{EP}}$, v(t) becomes E and i(t)=0. Thereafter, this condition is maintained unless the controlled rectifier 24 is turned on again. FIG. 4 shows the waveform of v(t) and i(t) as mentioned above.

Figure 5:
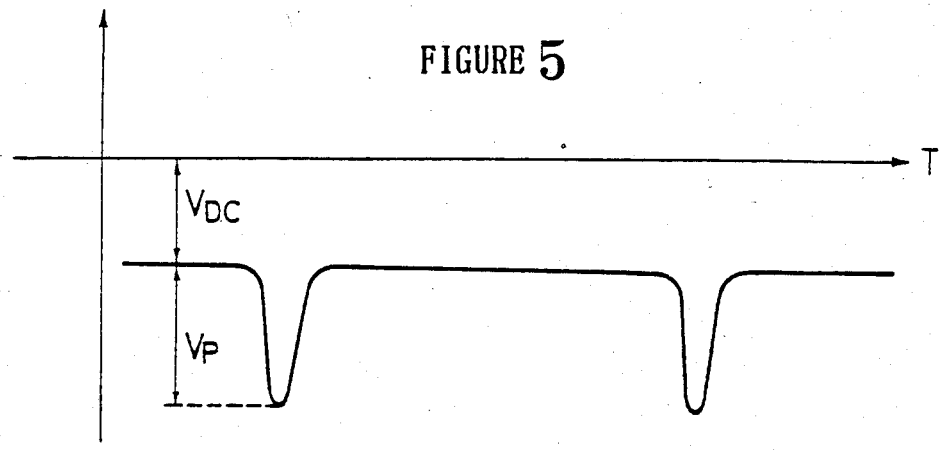
FIG. 5 shows a waveform of the voltage applied to the precipitator by the power source shown in FIG. 3.

Therefore, the DC component is removed from the voltage v(t) by the coupling capacitor 22 and an AC component $V_P$ of the voltage v(t) is superimposed upon the high DC voltage $V_{DC}$ supplied from the DC source 11 to the discharge electrodes 7, as shown in FIG. 5. As a result, an intense corona discharge is generated in the form of a pulse in the electrostatic precipitator, since the voltage $v_{DC}$ from the DC source corresponds to the corona discharge starting voltage in the precipitator.

Figure 6:
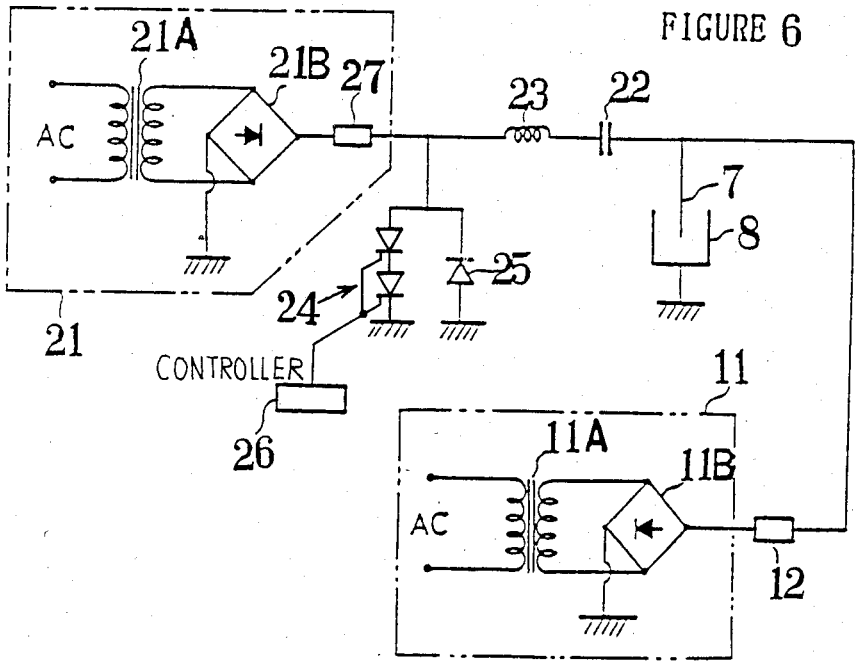
FIGS. 6 and 7 are circuit diagrams of second and third embodiments of the present invention.

Referring to FIG. 6, there is shown a second embodiment of the power source in accordance with the present invention. Portions similar to those of the power source shown in FIG. 3 are given the same Reference Numerals and explanation on those portions will be omitted. The only difference between the first and second embodiments is that in the second embodiment the output of the DC source 21 is connected to the connection between the inductor 23 and the controlled rectifier 24. The second embodiment operates in a manner similar to the first embodiment. But, the impedance 27 can be omitted if the transformer 21A has a sufficiently large output impedance so as to make as small as possible the current flowing from the DC source 21 through the controlled rectifier 24 to the ground when the controlled rectifier 24 is turned on.

Figure 7:
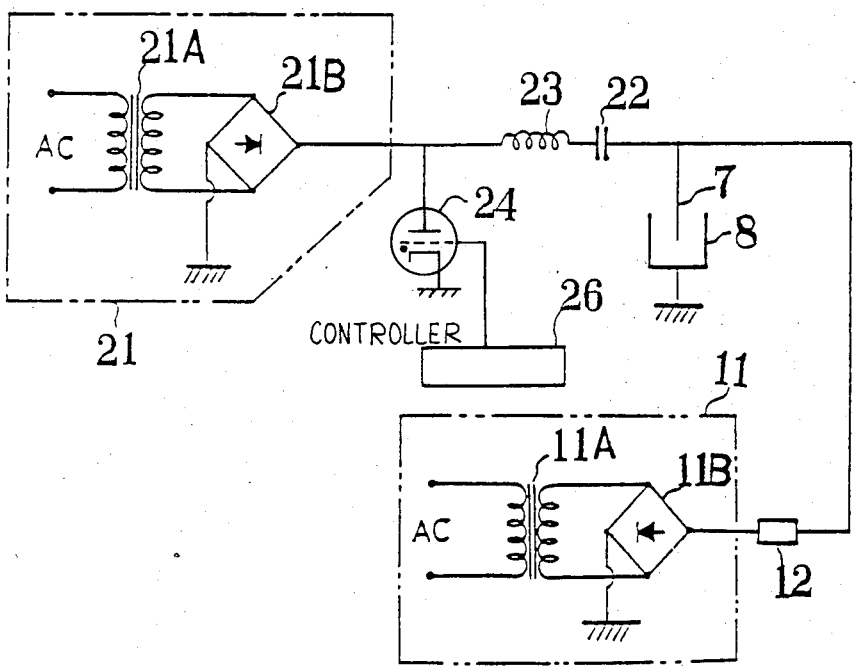

Referring to FIG. 7, there is shown a third embodiment. Portions of this third embodiment similar to those of the power source shown in FIG. 6 are given the same Reference Numerals and an explanation of those portions will be omitted. The only different feature here is that the diode 25 and the impedance 27 are omitted and the rectifier bridge 21B performs the function of the diode 25. In this embodiment, the transformer 21A is required to have a large inductance so that the DC source 21 has a sufficiently large impedance so as to make as small as possible the current flowing from the DC source 21 through the controlled rectifier 24 to ground when the controlled rectifier 24 is turned on. Otherwise, a current-limiting reactor may be connected in series with the primary or secondary winding of the transformer 21A.

As seen from the above, the power source in accordance with the present invention can supply a high DC voltage superimposed with voltage pulses without any need for the storage capacitor which is required in the conventional device. Therefore, the power source is made much more inexpensive than the conventional device.

In addition, in the power source in accordance with the present invention, since the cathode of the controlled rectifier is grounded, the potential difference between the gate and the cathode of the controlled rectifier is not subjected to the influence of the precipitator. Therefore, the controlled rectifier can be easily and precisely turned on and off by a simple and inexpensive controller.

The embodiments of the invention in which an exclusive property or privilege is claimed are defined as follows:

1. An electric power source for use in an electrostatic precipitator having a discharge electrode, comprising a first high voltage DC source having an output terminal adapted to be connected to the discharge electrode of the electrostatic precipitator, an inductor having one end connected through a coupling capacitor to said output terminal, a controlled rectifier having its anode connected to the other end of said inductor and its cathode connected to ground, a diode connected in reversed parallel to said controlled rectifier, a second high voltage DC source having a high output impedance and connected to said inductor, and a controller which can supply a trigger pulse to the gate of said controlled rectifier, wherein said controller is an independently operated pulse generator, wherein said second high voltage DC source is connected to said other end of said inductor, and wherein said second high voltage DC source includes a power transformer having a primary winding connected to an AC power source and a secondary winding of a high impedance connected through a rectifier bridge to said inductor.

2. An electric power source for use in an electrostatic precipitator having a discharge electrode, comprising a first high voltage DC source having an output terminal adapted to be connected to the discharge electrode of the electrostatic precipitator, an inductor having one end connected through a coupling capacitor to said output terminal, a controlled rectifier having its anode connected to the other end of said inductor and its cathode connected to ground, a diode connected in reversed parallel to said controlled rectifier, a second high voltage DC source having a high output impedance and connected to said inductor, and a controller which can supply a trigger pulse to the gate of said controlled rectifier, wherein said controller is an independently operated pulse generator, wherein said second high voltage DC source is connected to said other end of said inductor, and wherein said second high voltage DC source includes a power transformer having a primary winding connected to an AC power source and a secondary winding connected to a rectifier bridge, said rectifier bridge having an output which is connected through a high impedance element to said inductor.

3. An electric power source for use in an electrostatic precipitator having a discharge electrode, comprising a first high voltage DC source having an output terminal adapted to be connected to the discharge electrode of the electrostatic precipitator, an inductor having one end connected through a coupling capacitor to said output terminal, a controlled rectifier having its anode connected to the other end of said inductor and its cathode connected to ground, a diode connected in reversed parallel to said controlled rectifier, a second high voltage DC source having a high output impedance and connected to said inductor, and a controller which can supply a trigger pulse to the gate of said controlled rectifier, wherein said second high voltage DC source is connected to said other end of said inductor, and wherein said second high voltage DC source includes a power transformer having a primary winding connected to an AC power source and a secondary winding of a high impedance connected through a rectifier bridge to said inductor.

4. An electric power source for use in an electrostatic precipitator having a discharge electrode, comprising a first high voltage DC source having an output terminal adapted to be connected to the discharge electrode of the electrostatic precipitator, an inductor having one end connected through a coupling capacitor to said output terminal, a controlled rectifier having its anode connected to the other end of said inductor and its cathode connected to ground, a diode connected in reversed parallel to said controlled rectifier, a second high voltage DC source having a high output impedance and connected to said inductor, and a controller which can supply a trigger pulse to the gate of said controlled rectifier, wherein said second high voltage DC source is connected to said other end of said inductor, and wherein said second high voltage DC source includes a power transformer having a primary winding connected to an AC power source and a secondary winding connected to a rectifier bridge, said rectifier bridge having an output which is connected through a high impedance element to said inductor.

5. An electric power source for an electrostatic precipitator, including a first high voltage DC source having an output terminal adapted to be connected to a discharge electrode of the electrostatic precipitator, and a pulse generator adapted to be connected to the discharge electrode of the electrostatic precipitator through a coupling capacitor, so that a DC voltage superimposed with a pulse voltage is applied to the discharge electrode of the electrostatic precipitator, wherein the improvement comprises said pulse generator including an inductor having one end connected to an end of said coupling capacitor opposite to the end thereof connected to the discharge electrode, a controlled rectifier having a gate, having an anode connected to a second end of said inductor remote from said one end thereof, and having a cathode connected to ground, a diode connected in parallel with said controlled rectifier so as to have its direction of conduction opposite to that of said controlled rectifier, a second high voltage DC source having a high output impedance and connected to said inductor, and controller means for supplying to said gate of said controlled rectifier a trigger pulse which makes said controlled rectifier conductive.

6. An electric power source as set forth in claim 5, wherein said controller means includes an independently operated pulse generator.

7. An electric power source as set forth in claim 6, wherein said second high voltage DC source is connected to said second end of said inductor.

8. An electric power source as set forth in claim 7, wherein said second high voltage DC source includes a rectifier bridge and a power transformer having a primary winding connected to an AC power source and a secondary winding of high impedance connected through said rectifier bridge to said inductor.

9. An electric power source as set forth in claim 8, wherein said diode is a part of said rectifier bridge.

10. An electric power source as set forth in claim 7, wherein said second high voltage DC source includes a rectifier bridge, a high impedance element, and a power transformer having a primary winding connected to an AC power source and a secondary winding connected to said rectifier bridge, said rectifier bridge having an output which is connected through said high impedance element to said inductor.

11. An electric power source as set forth in claim 8, wherein said second high voltage DC source is connected to said one end of said inductor.

12. An electric power source as set forth in claim 11, wherein said second high voltage DC source includes a rectifier bridge, a high impedance element, and a power transformer having a primary winding connected to an AC power source and a secondary winding connected to said rectifier bridge, said rectifier bridge having an output which is connected through said high impedance element to said inductor.

13. An electric power source as set forth in claim 5, wherein said second high voltage DC source is connected to said second end of said inductor.

14. An electric power source as set forth in claim 13, wherein said second high voltage DC source includes a rectifier bridge and a power transformer having a primary winding connected to an AC power source and a secondary winding of high impedance connected through said rectifier bridge to said inductor.

15. An electric power source as set forth in claim 14, wherein said diode is a part of said rectifier bridge.

16. An electric power source as set forth in claim 13, wherein said second high voltage DC source includes a rectifier bridge, a high impedance element, and a power transformer having a primary winding connected to an AC power source and a secondary winding connected to said rectifier bridge, said rectifier bridge having an output which is connected through said high impedance element to said inductor.

17. An electric power source as set forth in claim 5, wherein said second high voltage DC source is connected to said one end of said inductor.

18. An electric power source as set forth in claim 17, wherein said second high voltage DC source includes a rectifier bridge, a high impedance element, and a power transformer having a primary winding connected to an AC power source and a secondary winding connected to said rectifier bridge, said rectifier bridge having an output which is connected through said high impedance element to said inductor.

19. An electric power source as set forth in claim 5, wherein said controlled rectifier includes a plurality of thyristors connected in series.

20. An electric power source as set forth in claim 5, wherein said controlled rectifier is a thyratron.

* * * * *

UNITED STATES PATENT AND TRADEMARK OFFICE

CERTIFICATE OF CORRECTION

PATENT NO. : 4 567 541

DATED : January 28, 1986

INVENTOR(S) : Hiroshi Terai

It is certified that error appears in the above-identified patent and that said Letters Patent is hereby corrected as shown below:

Column 9, line 29; change "claim 8" to ---claim 6---.

Signed and Sealed this

*Twenty-second* Day of *July 1986*

[SEAL]

*Attest:*

DONALD J. QUIGG

*Attesting Officer*

*Commissioner of Patents and Trademarks*